US007700537B2

(12) United States Patent
Atkins, Jr. et al.

(10) Patent No.: US 7,700,537 B2
(45) Date of Patent: Apr. 20, 2010

(54) CLEANING SOLVENT FOR SILICONE CAULK

(76) Inventors: Don Carlos Atkins, Jr., 2992 Silverwood Dr., Los Alamitos, CA (US) 90720; R. Kevin Dawes, 920 Heritage Dr., West Covina, CA (US) 91791

( * ) Notice: Subject to any disclaimer, the term of this patent is extended or adjusted under 35 U.S.C. 154(b) by 0 days.

(21) Appl. No.: 11/894,175

(22) Filed: Aug. 20, 2007

(65) Prior Publication Data

US 2009/0054288 A1 Feb. 26, 2009

(51) Int. Cl.
*C11D 7/50* (2006.01)

(52) U.S. Cl. ..... 510/200; 510/417; 510/238; 510/365

(58) Field of Classification Search ..... 510/200, 510/229, 417, 422
See application file for complete search history.

(56) References Cited

U.S. PATENT DOCUMENTS 5,814,588 A * 9/1998 Cala et al. ..... 510/175
5,952,281 A * 9/1999 Mondin et al. ..... 510/365
6,136,766 A * 10/2000 Inada et al. ..... 510/167
6,506,261 B1 * 1/2003 Man ..... 134/39
6,838,426 B1 * 1/2005 Zeilinger ..... 510/417
7,198,822 B2 4/2007 Steinwandt et al.
2006/0247150 A1 * 11/2006 Molinaro et al. ..... 510/499

* cited by examiner

*Primary Examiner*—David Wu
*Assistant Examiner*—M. Reza Asdjodi
(74) *Attorney, Agent, or Firm*—Roy A. Ekstrand

(57) ABSTRACT

A joint area formed by intersecting surfaces is provided with a caulk seal using a conventional caulking gun to apply an initial bead of silicone-based caulk to the joint. Thereafter, a spray of cleaning solvent is immediately applied to the caulk bead and the surrounding surfaces of the joint area to provide complete covering. Excess caulk is removed from the joint such as through finger wiping, to provide a smoothed caulk joint corner. A cloth fiber patch is soaked to saturation in cleaning solvent and is smoothly stroked across the smoothed joint surface to further finish the caulk material surface and to remove traces of excess caulk material from the adjoining or intersecting surfaces. In an exemplary embodiment, the cleaning solvent is used to caulk a tub and wall joint area of a typical bathroom facility and includes a formula of soft distilled water, glycol ether DPM, a surfactant and an antifoaming agent.

1 Claim, 5 Drawing Sheets

CLEANING SOLVENT FOR SILICONE CAULK

FIELD OF THE INVENTION

This invention relates generally to caulking systems and particularly to cleaning solvent used in caulking systems and methods employed in cleaning residue and excess caulk. The invention further relates to creation of seals such as bathroom wall and tub joints. The invention also relates to other fabrications using sealing caulk between surfaces.

BACKGROUND OF THE INVENTION

In the building and renovation industries, one of the most vexing and time consuming tasks associated with the installation, construction and remodeling of the bathroom area of a typical dwelling is found in the need to caulk or seal the intersecting joints such as those between tub surface areas and adjoining wall areas. For example, in a typical bathtub facility, an enclave is provided within which an elongated tub is situated. The tub typically defines a bathing receptacle or recess surrounded by a relatively broad upper rim or edge. Most typically, at least a portion of the upper rim of the bathtub receptacle defines a generally planar portion having curved corners intended to be seated against the surrounding walls of the tub facilitate enclave. Usually, the wall surfaces are covered with a water repellant material such as ceramic tile which intersects a portion of the upper rim of the tub receptacle. Despite the best efforts of tub installers to carefully fit the tub within the surrounding walls, their remains nonetheless a joint or seam which must be effectively sealed to prevent water leakage behind the tub and into the surrounding walls and below. This seal is usually provided by an application of a caulking material applied using a conventional caulking gun. The caulking gun applies a bead of caulking material within and upon the joint seam and surfaces. The most common and long lasting types of caulk used in such applications employ a silicone caulk material which, while effective once installed, is a sticky material which is difficult to work with. In many instances, incorrectly applied caulking seals result in leaking or unsightly unattractive areas of the tub to wall joint. Even the most expert of tub installers frequently find that an extensive cleanup of the caulked portion of the tub and tub walls must be undertaken to provide an aesthetically pleasing installation.

In another industry, the practice of construction and renovation of marine vessels, a similar need arises to caulk, seal or apply adhesives to intersecting joints between areas such as deck portions, between the interlines and the hull and various fittings which pass through the vessel hull. In addition, numerous windows and portholes within the vessel require careful and thorough sealing. Despite the best efforts employed by fabricators to carefully fit the various deck and hull portions together, there remains a joint or seam which must be effectively sealed to prevent water leakage passing behind the deck through the deck to hull seal. This seal is usually provided by an application of a silicone adhesive sealant in a process similar to the above-described caulking operation in building fabrication. For the most part, such caulking and sealing operations utilize a silicone caulk material which is similar to the above-described caulk. As with tub caulk, the material is effective when properly installed but which is also a tacky and difficult material to work with.

In another similar industry application, aircraft fabricators and renovators often need to provide effective seal joints between various aircraft portions such as aircraft skin to airframe joints and airframe to deck joints within the aircraft. This need is typically met utilizing a silicone adhesive sealant applied as a caulking bead in a similar fashion to that described above for building industries and marine industries. In further similarity to the above-described application of adhesive caulking materials, the need arises within the aircraft industry to avoid defective seals and unattractive seal beads caused by improper caulking or caulking excess. The aircraft industry is similarly vexed by cleanup problems in its attempts to effectively utilize adhesive sealing materials in the caulking type operations described above.

Thus, despite the benefits of silicone-based caulking materials, their use is subject to problems of difficult installation and often labor intensive cleanup involving careful hand work which in turn leads to increased cost. As more and more tasks become greatly automated and labor becomes a growing substantial expense in construction and remodeling operations within the building, marine and aircraft industries, practitioners have endeavored to provide less labor intensive alternatives. To date, however, these efforts have been generally unsuccessful and the task of caulking a joint area such as a tube to wall joint remains a difficult and labor intensive process.

One substantial improvement in the cleanup process relating to caulk joints has been provided by a product and cleanup method marketed under the trademark Caution: Don't Caulk Without Me! in 2000. This product utilized a spray solvent formed of isopropyl alcohol and set forth a cleanup method having the steps of: applying a bead of silicone caulk to the seam; immediately spraying cleaning solution over the caulk bead and adjacent areas on each side of the caulk bead; and removing excess caulk by dragging a finger along the caulk seam using medium pressure.

U.S. Pat. No. 7,198,822 issued Apr. 3, 2007 sets forth this same method based upon a parent application Ser. No. 10/712,667 filed Nov. 13, 2003, now abandoned.

SUMMARY OF THE INVENTION

Accordingly, it is a general object of the present invention to provide an improved solvent for cleanup of caulking joint areas. It is a more particular object of the present invention to provide an improved solvent for cleaning caulking joint areas utilizing a silicone-based caulk which avoids extensive labor and cleanup costs.

In accordance with the present invention, there is provided a cleaning solvent method for cleaning a caulking joint area using a method comprising the steps of: applying a bead of caulk material to the joint area; immediately spraying a quantity of an cleaning solvent upon the bead formed and upon the adjacent areas on each side of the joint area, using a cleaning solvent formed of Glycol Ether DPM sold by Chem Central, 9N9 Surfactant and D.C. Silicone 2210 Antifoam both sold by Norfox Chemical Co. with soft/D.I. water added to provide the desired flash point and flammability characteristics.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT OF THE INVENTION

By way of example, FIGS. 1 through 4 illustrate the application of a silicone-based caulking material to a bathtub-to-wall enclosure joint and clean-up using the present invention clean-up solvent. It will be understood that the present invention solvent applies equally well to other industries such as the marine and aircraft industries described above. Accordingly, FIGS. 1 through 4 described the use of the present invention caulking material cleaning solvent in an exemplary environment. Because of the more general application which the present invention cleaning solvent embraces, FIG. 5 sets forth a generalized block diagram of a clean-up method which utilizes the present invention cleaning solvent as applied to a number of industries such as building, marine and aircraft.

Figure 1:
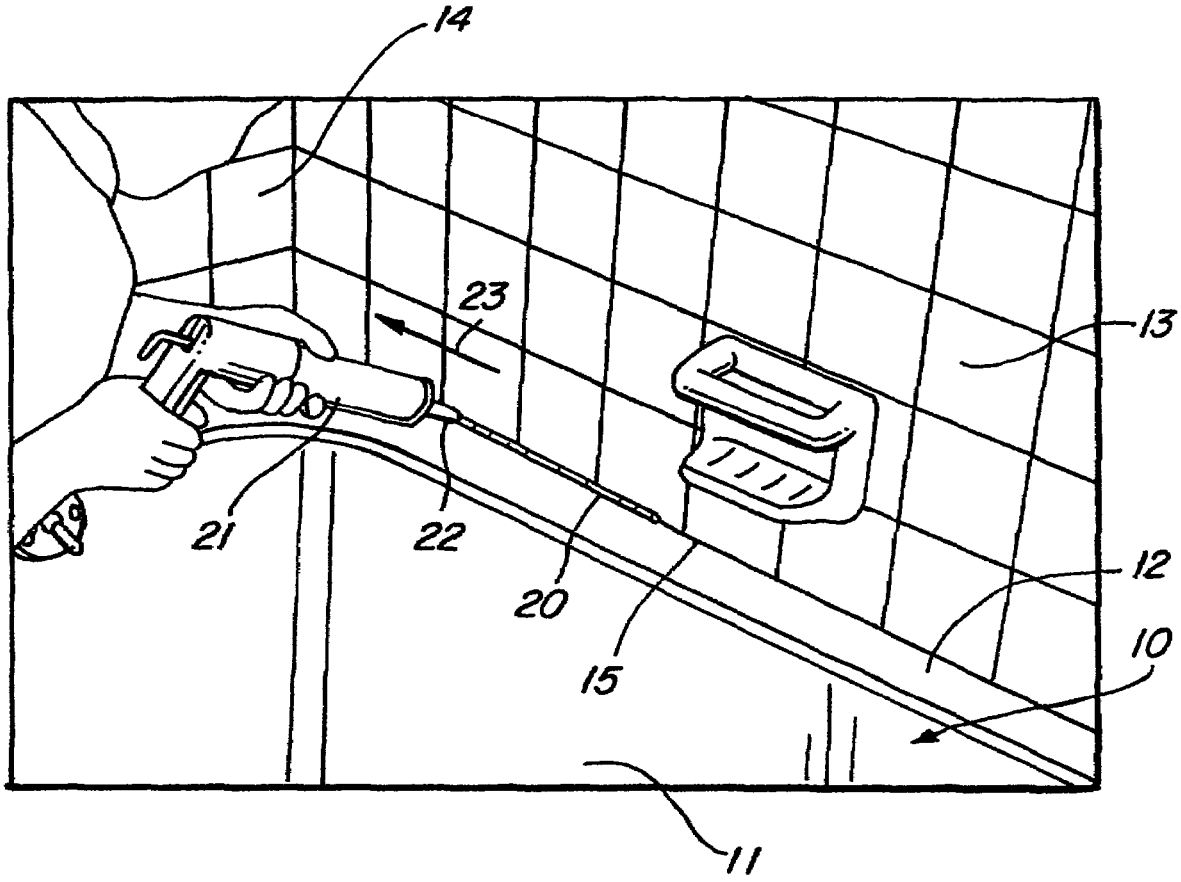
FIG. 1 sets forth a perspective view of a caulk bead application step utilizing a silicone-based caulking material of the type to which the present invention cleaning solvent cleaning method applies.

More specifically, FIG. 1 sets forth a perspective view of a typical bathroom tub bathing area having a tub 10 defining a bathing recess 11 and a surrounding rim 12. In further accordance with conventional fabrication techniques, the tub area shown in FIG. 1 includes surrounding walls 13 and 14 which meet to form a common corner and which extend downwardly to the upper surface of rim 12 forming a joint 15 therebetween. Joint 15 is the troublesome joint referred to above which requires a sealing caulk and which has heretofore provided such substantial difficulty in the above-described prior art caulking operations. In FIG. 1, the initial step of applying a caulk bead 20 at joint 15 is shown being undertaken as the user manipulates a conventional caulking gun 21 having a generally tapered nozzle 22. As the user applies a stream of caulk material through nozzle 22 against joint 15, joint 15 is filled and an overlying caulk bead 20 is formed in the direction indicated by arrow 23. This process is carried forward until a caulk bead 20 extends entirely about joint 15 beneath walls 13 and 14 as they intersect rim 12 of bathroom 10.

Figure 2:
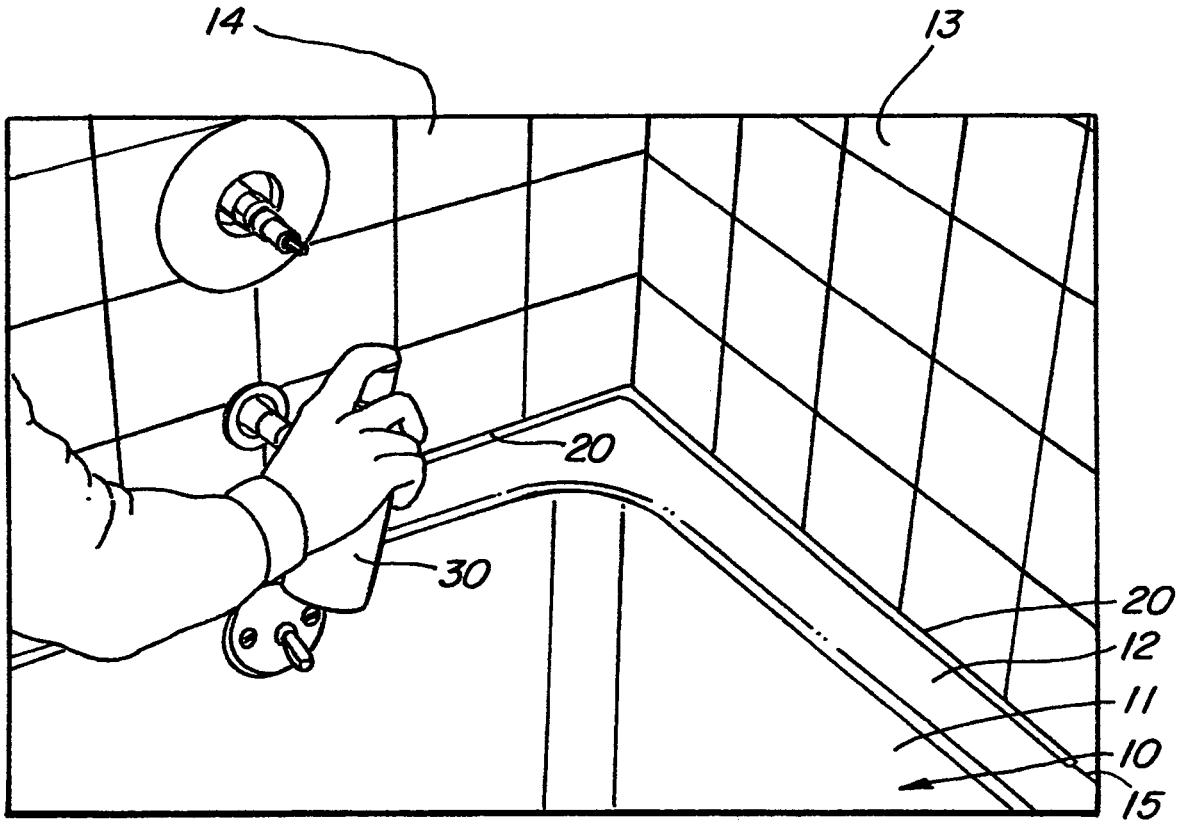
FIG. 2 sets forth a perspective view of the initial spraying step in the cleaning process using the present invention cleaning solvent.

FIG. 2 sets forth the next step in the caulking the joint area once again showing tub 10 having recess 11 and upper rim 12 positioned against walls 13 and 14. In the step shown in FIG. 2, the user has completed application of caulk bead 20 covering joint 15. For purposes of illustration, however, a small portion of joint 15 is shown without caulk bead 20 to facilitate a comparison of the caulking bead and initial joint portion. The process step carried forward in FIG. 2 is undertaken immediately following the application of caulk bead 20 in which a conventional spray bottle 30 having a spray producing apparatus is filled with the present invention cleaning solvent. The present invention cleaning solvent is described below in greater detail. However, suffice it to note here that the present invention cleaning solvent is low enough in viscosity to allow it to spray in a fine mist spray. The present invention cleaning solvent within spray bottle 30 is sprayed upon caulking bead 20 and the surrounding surfaces of walls 13 and 14 and tub rim 12 as soon as possible following caulking.

Figure 3:
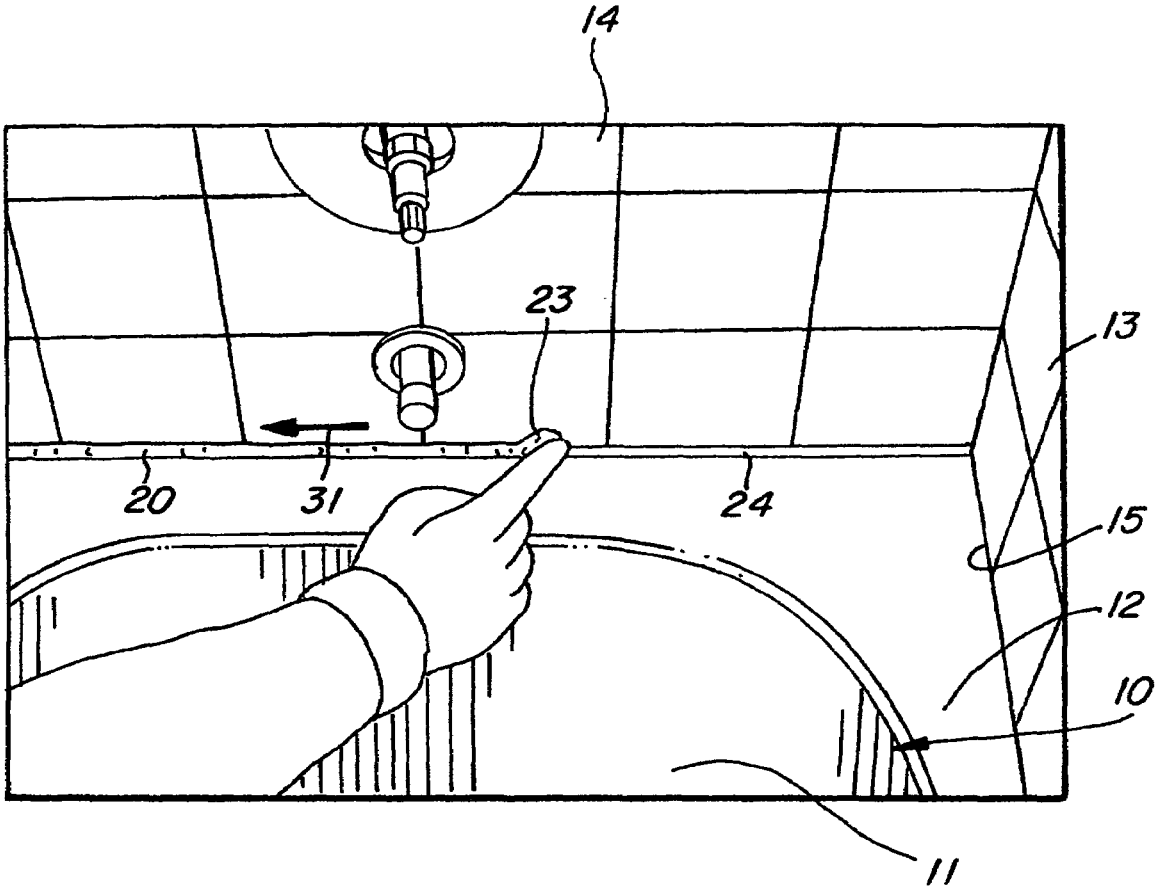
FIG. 3 sets forth a perspective view of the excess removal step using the present invention cleaning solvent.

FIG. 3 sets forth the next step in which the applied sprayed cleaning solvent has been completely applied to areas adjacent caulk bead 20 and the user forms a smoothed corner 24 along joint 15. In the operation shown in FIG. 3, the user simply places a finger against the corner joint and moving the finger against corner bead 20 in the direction indicated by arrow 31 removes the excess buildup 23 leaving behind a smoothed corner 24 along joint 15. This smoothing process is greatly facilitated by the presence of the present invention cleaning solvent previously sprayed following the application of the caulk bead.

Figure 4:
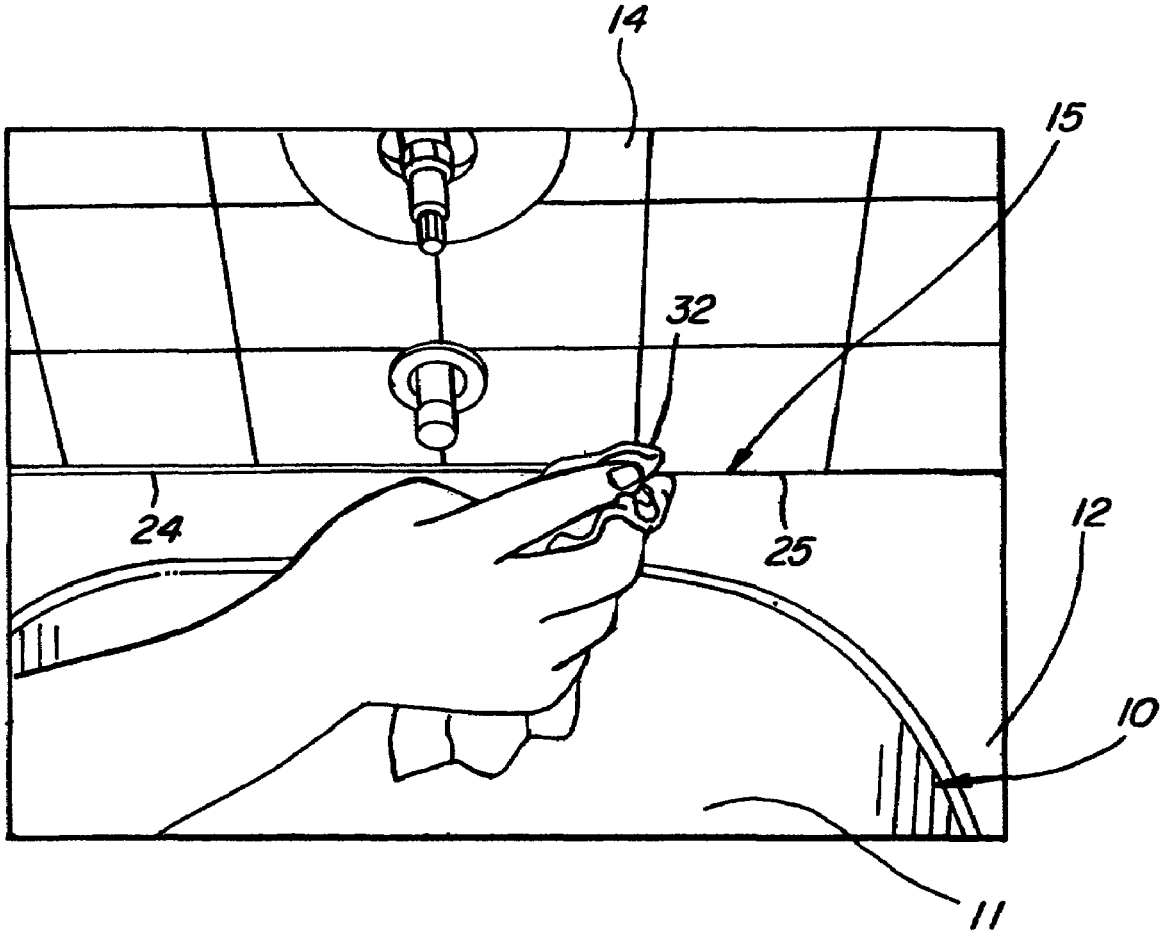
FIG. 4 sets forth a perspective view of the final step in the cleanup operation using the present invention cleaning solvent.

FIG. 4 sets forth the final cleanup for caulking joint areas using the present invention cleaning solvent. Wall 14 and tub 10 are shown in a slightly enlarged perspective view. Rim 20 and wall 14 form a joint as described above and referenced as joint 15 which supports a smoothed corner 24 resulting from the step described above in FIG. 3. The final step depicted in FIG. 4 is carried forward using a small fabric piece 32 which has been saturated with the present invention cleaning solvent. The saturated material fabric piece 32 is moved across smoothed corner 24 at joint 15 providing a further smoothing action while simultaneously removing traces of caulk material which remain upon rim surface 12 and wall 14. The final wiping of smoothed corner 24 with the present invention cleaning solvent provides a unique smoothing action and improves the surface appearance of the remaining caulk material within joint 15. As a result, a finished joint 25 is provided at joint 15 which effectively seals the wall to tub rim joint while also providing a pleasant appearance.

Figure 5:
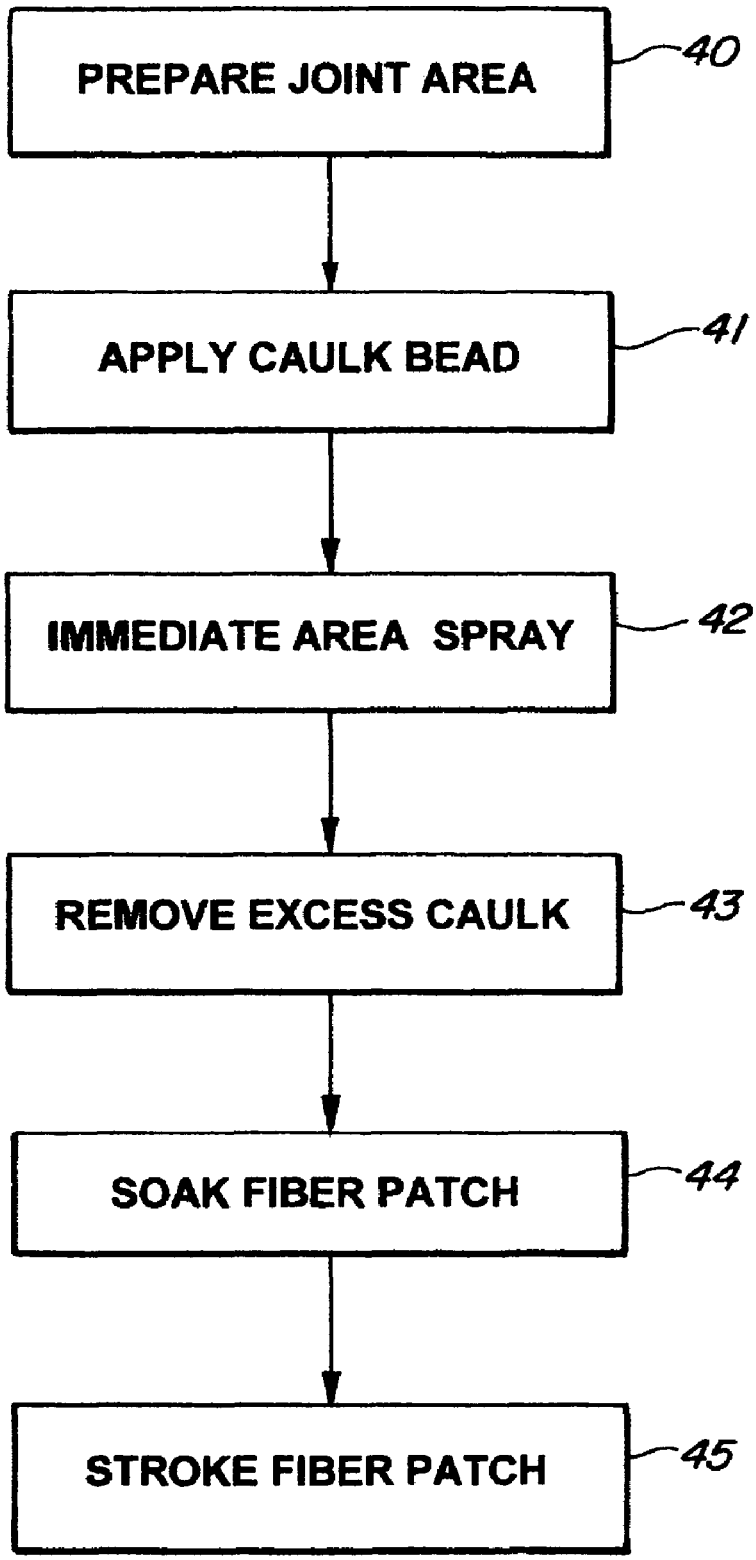
FIG. 5 sets forth a block diagram of the preferred method for cleaning caulking joint areas using the present invention cleaning solvent.

FIG. 5 sets forth a block diagram of an illustrative method and system for cleaning caulking joint areas utilizing the present invention cleaning solvent. The cleaning method and system commences at an initial step 40 in which the joint area is prepared by cleaning and removing all loose material, dust and the like as well as all grease or oil from the adjoining surfaces at the to-be-caulked joint. Once the joint area is properly prepared and cleaned and is free of grease at step 40, the method moves to step 41 in which a caulk bead is formed using for example a conventional caulking gun to establish a bead of caulk at the joint. It is important to ensure at step 41 that the caulk adheres to the adjoining surfaces of the joint and the caulk bead is free of gaps. Preferably, the caulk bead form should be relatively even in material distribution. Thereafter, the method and system moves immediately to step 42 in which an the present invention cleaning solvent is sprayed upon the caulk bead and the adjacent joint or intersecting surfaces on either side of the caulked joint. Care is taken at this step 42 to move quickly and to apply a thorough covering coat of the cleaning solvent. Thereafter, the method and system moves to a step 43 in which the excess caulk material is removed from the caulk bead by wiping the residue. Preferably, the excess is removed by stroking a finger end upon the joint in one to two foot sections and periodically removing the built-up excess residue at the user's fingers. At this point, large quantities of caulk material outside the joint area should also be removed using a simple wiping towel. Thereafter, at step 44 a small cloth fiber patch is saturated with the present invention cleaning solvent. At step 45, the method is completed as the saturated fiber cloth patch is moved repeatedly across the joint area further smoothing the caulk material within the joint and simultaneously removing traces of caulk material residing upon adjoining or intersecting surfaces. In most instances, step 45 usually requires one gentle stroke to remove any excess caulk. The resulting finish provides a smoothed aesthetically pleasing caulk joint which is free of undesired smearing or overrun of the caulk material.

It will be recognized by those skilled in the art that the use of the present invention cleaning solvent spray liquid greatly facilitates and improves the application and clean-up of caulk to the joint areas in accordance with the above-described method. Because the present invention cleaning solvent allows the effective and straightforward application and finishing of the caulk joint without the need to patch gaps or botched areas, the resulting caulk joint is substantially better and provides a more effective seal than is typically realized in the prior art systems.

As described above, it will be further recognized by those skilled in the art that while the present invention cleaning solvent is illustrated in use upon a tub and bathroom wall joints, it is by no means limited to such use. For example, the present invention may be used for other caulked joints such as sinks, showers, glass surfaces and fiberglass within the building industry. Further, the present invention system is also useful for recreational vehicles or the like as well as aircraft and marine fabrication and renovation.

In accordance with the present invention, the above-described method of cleaning a silicone-based caulked joint is optimized utilizing the present invention cleaning solvent. The present invention solvent utilizes a glycol ether based solvent material together with a surfactant in combination with a silicone antifoam additive. A quantity of softened distilled water is added to complete the proper mixture of the present invention cleaning solvent in order to provide the desired flash point and flammability characteristics for the solvent. The present invention solvent is blended in a suitably sized blending tank having a variable speed mixer such as a well-known "lightning" type mixer. Appropriate weighing containers, hoses, valves and similar apparatus for manufacturing is required. Preferably, a calibrated weighing scales capable of weighing raw material containers is also utilized. Because Glycol Ether is a combustible material, all sources of ignition must be removed from areas in which the present invention solvent is being manufactured, stored or utilized.

While the formula of the present invention cleaning solvent may be varied somewhat to suit particular silicone-based caulk material, a mixture which has proven to be very advantageous in has been attained by mixing the ingredients in accordance with the following table:

TABLE 1

| INGREDIENT | WT. % |
|---|---|
| Soft/D.I. Water | 78.98 |
| Glycol Ether DPM | 20.00 |
| 9N9 Surfactant | 1.00 |
| D.C. Silicone 2210 Antifoam | 0.02 |
| | 100.00 |

The present invention cleaning solvent has been found particularly advantageous in cleaning operations associated with the use of silicone-based caulking or putty materials. However, it will be apparent to those skilled in the art that the material of the present invention cleaning solvent may be utilized in cleaning operations associated with other materials and other adhesives. In particular, materials which are silicone-based are optimally cleaned by the present invention cleaning solvent.

It will equally apparent to those skilled in the art that while the formula of ingredients for the present invention cleaning solvent set forth in table 1 is regarded as particularly advantageous, the relative proportions of ingredients may be varied without departing from the spirit and scope of the present invention. Accordingly, variations of the ingredients have been tested and found to enjoy successful operation such that variations in accordance with the following are believed to fall within the spirit and scope of the present invention.

TABLE 2

| INGREDIENT | WT. % |
|---|---|
| Glycol Ether | 15 to 25 |
| 9N9 Surfactant | 0.5 to 1.5 |
| D.C. Silicone 2210 Antifoam | 0.005 to 0.03 |
| Soft/D.I. Water | to completion |

In addition to the above-described variation of ingredients, it has been found in certain applications that the use of an antifoam material may be omitted without departing from the spirit and scope of the present invention. Additionally, extensive dilution of the basic materials set forth above in tables 1 and 2 with additional quantities of soft distilled water may also be employed without departing from the spirit and scope of the present invention.

In a more general sense, the present invention cleaning solvent may be viewed as a formula comprised of a concentrate formed by combining Glycol Ether, 9N9 Surfactant and D.C. Silicone 2210 Antifoam and thereafter adding the appropriate amount of Soft/D.I. Water to mix solvent for each need. Using this approach, the concentrate is mixed in accordance with the following table.

TABLE 3

| INGREDIENT | WT % |
|---|---|
| Glycol Ether | 94 |
| 9N9 Surfactant | 4.9 |
| D.C. Silicone 2210 Antifoam | .1 |

In a more general sense, the concentrate may be varied as set forth in the following table.

TABLE 4

| INGREDIENT | WT % |
|---|---|
| Glycol Ether | 70 to 95 |
| 9N9 Surfactant | 2 to 8 |
| D.C. Silicone 2210 Antifoam | 0.01 to 1 |

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A cleaning solvent for use on silicone-based adhesives, said cleaning solvent consisting of:

| INGREDIENT | WT. % |
|---|---|
| Soft/D.I. Water | 78.98 |
| Glycol Ether DPM | 20.00 |

-continued

| INGREDIENT | WT. % |
|---|---|
| Surfactant | 1.00 |
| Silicone Antifoam | 0.02 |
| | 100.00. |

* * * * *